US007782040B2

(12) United States Patent
Enomoto

(10) Patent No.: US 7,782,040 B2
(45) Date of Patent: Aug. 24, 2010

(54) INFORMATION PROCESSING TERMINAL AND RECEIVED VOLTAGE CONTROLLING METHOD

(75) Inventor: Kazuyoshi Enomoto, Tokyo (JP)

(73) Assignee: FeliCa Networks, Inc., Tokyo (JP)

( * ) Notice: Subject to any disclaimer, the term of this patent is extended or adjusted under 35 U.S.C. 154(b) by 567 days.

(21) Appl. No.: 11/759,110

(22) Filed: Jun. 6, 2007

(65) Prior Publication Data

US 2008/0059725 A1 Mar. 6, 2008

(30) Foreign Application Priority Data

Jun. 7, 2006 (JP) ..... P2006-158905

(51) Int. Cl.
*G05F 1/12* (2006.01)

(52) U.S. Cl. ..... 323/293

(58) Field of Classification Search ..... 323/293; 235/380; 435/43

See application file for complete search history.

(56) References Cited

U.S. PATENT DOCUMENTS 6,079,622 A * 6/2000 Goto ..... 235/492
6,234,902 B1 * 5/2001 Hazama ..... 463/43

FOREIGN PATENT DOCUMENTS

| | | |
|---|---|---|
| JP | 05-128319 | 5/1993 |
| JP | 05-059557 | 8/1993 |
| JP | 08-007059 | 1/1996 |
| JP | 10-187916 | 7/1998 |
| JP | 10-293823 | 11/1998 |
| JP | 10-320519 | 12/1998 |
| JP | 2001-222696 | 8/2001 |
| JP | 2003-011326 | 1/2003 |
| JP | 2003-067693 | 3/2003 |
| JP | 2003-271914 | 9/2003 |
| JP | 2004-46292 | 2/2004 |
| JP | 2006-072966 | 3/2006 |

* cited by examiner

*Primary Examiner*—Adolf Berhane
(74) *Attorney, Agent, or Firm*—Finnegan, Henderson, Farabow, Garrett & Dunner, L.L.P.

(57) ABSTRACT

Disclosed herein is an information processing terminal including: a resonance circuit unit configured to have a resonance frequency varying linearly in accordance with a control signal so as to receive data and power from a reader/writer in noncontact fashion at the resonance frequency; a maximum received voltage setting unit configured to output a reference voltage for defining a maximum received voltage to be output by the resonance circuit unit; a control signal generation unit configured to generate the control signal in accordance with the received voltage and the reference voltage; and a transmit-receive processing section configured to operate on the received voltage to process the data; wherein the received voltage is not in excess of a predetermined level.

8 Claims, 13 Drawing Sheets

INFORMATION PROCESSING TERMINAL AND RECEIVED VOLTAGE CONTROLLING METHOD

CROSS REFERENCES TO RELATED APPLICATIONS

The present invention contains subject matter related to Japan Patent Application JP 2006-158905 filed with the Japanese Patent Office on Jun. 7, 2006, the entire contents of which being incorporated herein by reference.

BACKGROUND OF THE INVENTION

1. Field of the Invention

The present invention relates to an information processing terminal and a received voltage controlling method.

2. Description of the Related Art

Recent years have seen widespread acceptance of information processing terminals such as noncontact IC (integrated circuit) cards (called the IC card hereunder) and RFID (radio frequency identification) tags capable of noncontact communication with reader/writers.

The IC card and RFID tag have no power sources of their own; they are driven by magnetic-field energy obtained from the reader/writer. More specifically, the reader/writer has a current flowing through its transmitting coil acting as a transmit-receive antenna so as to generate a magnetic field. The IC card and RFID tag are each included with a receiving coil serving as a transmit-receive antenna. When the magnetic field of the reader/writer is transited by the IC card or RFID tag with its receiving coil, the coil induces a voltage (called the induced voltage) in reaction to the magnetic field. The voltage thus generated serves to power the IC card and RFID tag.

The IC card and RFID tag communicate with the reader/writer emitting a magnetic field of a particular frequency such as 13.56 MHz. The ID card and RFID tag are each included with a resonance circuit set to resonate with that specific frequency. In operation, the IC card or RFID tag using its receiving coil acquires magnetic field energy from the transmitting coil of the reader/writer and receives a voltage (called the received voltage) by causing the induced voltage to resonate with the predetermined frequency.

In general, the shorter the distance between the reader/writer and the IC card or RFID tag, the higher the intensity of the magnetic field received by the IC card or RFID tag from the reader/writer. The level of the received voltage is also higher the shorter that distance.

Conversely, the longer the distance between the reader/writer and the IC card or RFID tag, the lower the intensity of the magnetic field received by the IC card or RFID tag from the reader/writer. The level of the received voltage is also lower the longer that distance.

If there exists an obstruction (e.g., another IC card) between the reader/writer and the IC card or RFID tag, the resonance frequency decreases and so does the received voltage.

Against the circumstance outlined above, efforts have been made to develop an information processing terminal capable of operating in a stable manner regardless of the varying level of the received voltage. As part of such efforts, Japanese Patent Laid-open No. 2001-222696 discloses a technique for stabilizing the performance of information processing terminals. Japanese Patent Laid-open No. 2004-46292 discloses a technique used by the reader/writer for controlling the power to be supplied to information processing terminals.

SUMMARY OF THE INVENTION

The information processing terminal in related art described above can control its received voltage by varying the resonance frequency in effect in accordance with the intensity of the received voltage but is incapable of linearly changing the resonance frequency. This may lead to a worsening of the efficiency of conversion to received voltage above and below a threshold level used for varying the resonance frequency. In situations unfavorable to communication such as where the reader/writer is far away from the information processing terminal in related art, the deteriorated efficiency in conversion to received voltage can result in an inoperative terminal.

The information processing terminal represented by the IC card or RFID tag communicates not only with the above-mentioned typical reader/writer capable of controlling the power it supplies, but also with other reader/writers that may not control their power supplies. In communicating with the latter type of reader/writer, the information processing terminal needs to stabilize its own performance regardless of the capabilities of the reader/writer.

Usually, the information processing terminal in related art has a clamping circuit designed to prevent the received voltage from exceeding the withstand voltage of the IC in the terminal. The trouble is that the clamping circuit is also activated when the received voltage is not very high. With the received voltage at a relatively low level, the clamping circuit in place can deprive the information processing terminal of the power it needs to function properly.

The present invention has been made in view of the above circumstances and provides an information processing terminal and a received voltage controlling method offering improvements for allowing the information processing terminal to continue functioning stably regardless of the intensity of the received voltage.

In carrying out the present invention and according to one embodiment, there is provided an information processing terminal including: a resonance circuit unit, a maximum received voltage setting unit, a control signal generation unit, and a transmit-receive processing section. The resonance circuit unit is configured to have a resonance frequency varying linearly in accordance with a control signal so as to receive data and power from a reader/writer in noncontact fashion at the resonance frequency. The maximum received voltage setting unit is configured to output a reference voltage for defining a maximum received voltage to be output by the resonance circuit unit. The control signal generation unit is configured to generate the control signal in accordance with the received voltage and the reference voltage. The transmit-receive processing section is configured to operate on the received voltage to process the data. The received voltage is not in excess of a predetermined level.

The inventive information processing apparatus above has the resonance circuit unit, maximum received voltage setting unit, control signal generation unit, and transmit-receive processing section. The resonance circuit unit is subjected to a magnetic field of a particular frequency constituting a carrier wave transmitted by the reader/writer to carry data and power, generates an induced voltage through electromagnetic induction, and outputs a received voltage by causing the induced voltage to resonate with a given resonance frequency within a predetermined range. The resonance frequency varies linearly with the control signal, to be described later. With the control signal varied linearly within a predetermined range, the resonance circuit unit can maximize the received voltage illustratively when the reader/writer is far away from the information processing terminal. When the reader/writer is close to the information processing terminal, the resonance circuit unit may output a received voltage not in excess of a predetermined level.

The maximum received voltage setting unit outputs a reference voltage for defining a maximum received voltage to be output by the resonance circuit unit. The control signal generation unit outputs the control signal obtained by integrating the received voltage and the reference voltage.

The control signal above is output in the same manner as that output by the AGC (automatic gain control) circuit for use in gain adjustment. That is, the AGC circuit using its control signal controls automatically the gain of an amplifier circuit in such a manner that the amplifier circuit may provide a constant output regardless of an input voltage with a variable amplitude. In like manner, where the amplitude of the received voltage is variable, the information processing terminal controls the received voltage by varying the resonance frequency based on the control signal.

The transmit-receive processing section uses the received voltage that is output by the resonance circuit unit as a power supply when processing data coming from the reader/writer.

The structure above allows the information processing terminal to continue functioning stably regardless of the varying level of the received voltage due to changing ambient conditions such as a varying distance between the reader/writer and the information processing terminal or the presence of an obstruction.

Preferably, the resonance circuit unit may constitute a resonance circuit including: a fixed inductance unit configured to function as an antenna having a predetermined inductance; and a variable capacitance unit configured to vary a capacitance in accordance with the control signal.

Where the resonance circuit is made up of the fixed inductance unit having a fixed inductance and the variable capacitance unit capable of varying its capacitance, the resonance frequency can be varied linearly by having the capacitance changed linearly. The received voltage output by the resonance circuit unit is thus changed in keeping with the varying capacitance.

Preferably, the resonance circuit unit may constitute a resonance circuit including: a variable inductance unit configured to vary an inductance in accordance with the control signal; and a fixed capacitance unit configured to have a fixed capacitance.

Where the resonance circuit unit is made up of the variable inductance unit capable of varying its inductance and the fixed capacitance unit having a predetermined capacitance, the resonance frequency can be varied linearly by having the inductance changed linearly. The received voltage output by the resonance circuit unit is thus changed in keeping with the varying inductance.

Preferably, the information processing terminal may be configured to be an IC card.

The IC card may be structured advantageously using the inventive information processing terminal. That is because the structure of the inventive terminal can efficiently apply to diverse processes the received voltage tapped from magnetic field energy acquired from the reader/writer, on condition that the received voltage may not be in excess of a predetermined level. Many IC cards do not have their own power sources. Because they are thin and small in structure, IC cards can be readily stacked on top of each other. In addition to such factors of potential instability, the IC card being thin and small makes it easy to change the distance between the card and the reader/writer. In view of the fact that the IC card is typically driven by power received from the outside and that the received voltage is prone to changes in intensity, application of the inventive structure to the IC card significantly enhances the stability of the IC card performance.

Preferably, the information processing terminal may be configured to be a portable communication apparatus.

Portable communication apparatuses such as a mobile phone or PHS (Personal Handyphone System) equipped with an IC card may also be structured advantageously using the inventive information processing terminal. That is because the structure of the inventive terminal can efficiently apply to diverse processes the received voltage tapped from magnetic field energy acquired from the reader/writer, on condition that the received voltage may not be in excess of a predetermined level as mentioned above. Such portable communication apparatuses may store an electronic money value inside for use in purchases with electronic money. Application of the inventive structure to the portable communication apparatus thus significantly contributes to normal execution of purchases using this type of apparatus regardless of the received voltage involved.

According to another embodiment of the present invention, there is provided a received voltage controlling method including the steps of: receiving data and power in noncontact fashion from a reader/writer so as to generate a received voltage at a given resonance frequency within a predetermined range; detecting the received voltage; generating a control signal based on the detected received voltage and on a predetermined maximum received voltage level; and varying the resonance frequency linearly in keeping with the control signal.

Where the inventive method above is in use, the resonance frequency can be varied linearly within a predetermined range. It is thus possible for the information processing terminal operated by this method to control the received voltage in a manner addressing diverse conditions such as the variable distance between the terminal and the reader/writer.

As outlined above, the information processing terminal according to the present invention can typically function stably regardless of the intensity of the received voltage.

BRIEF DESCRIPTION OF THE DRAWINGS

Further advantages of the present invention will become apparent upon a reading of the following description and appended drawings in which.

DETAILED DESCRIPTION OF THE PREFERRED EMBODIMENTS

Figure 1:
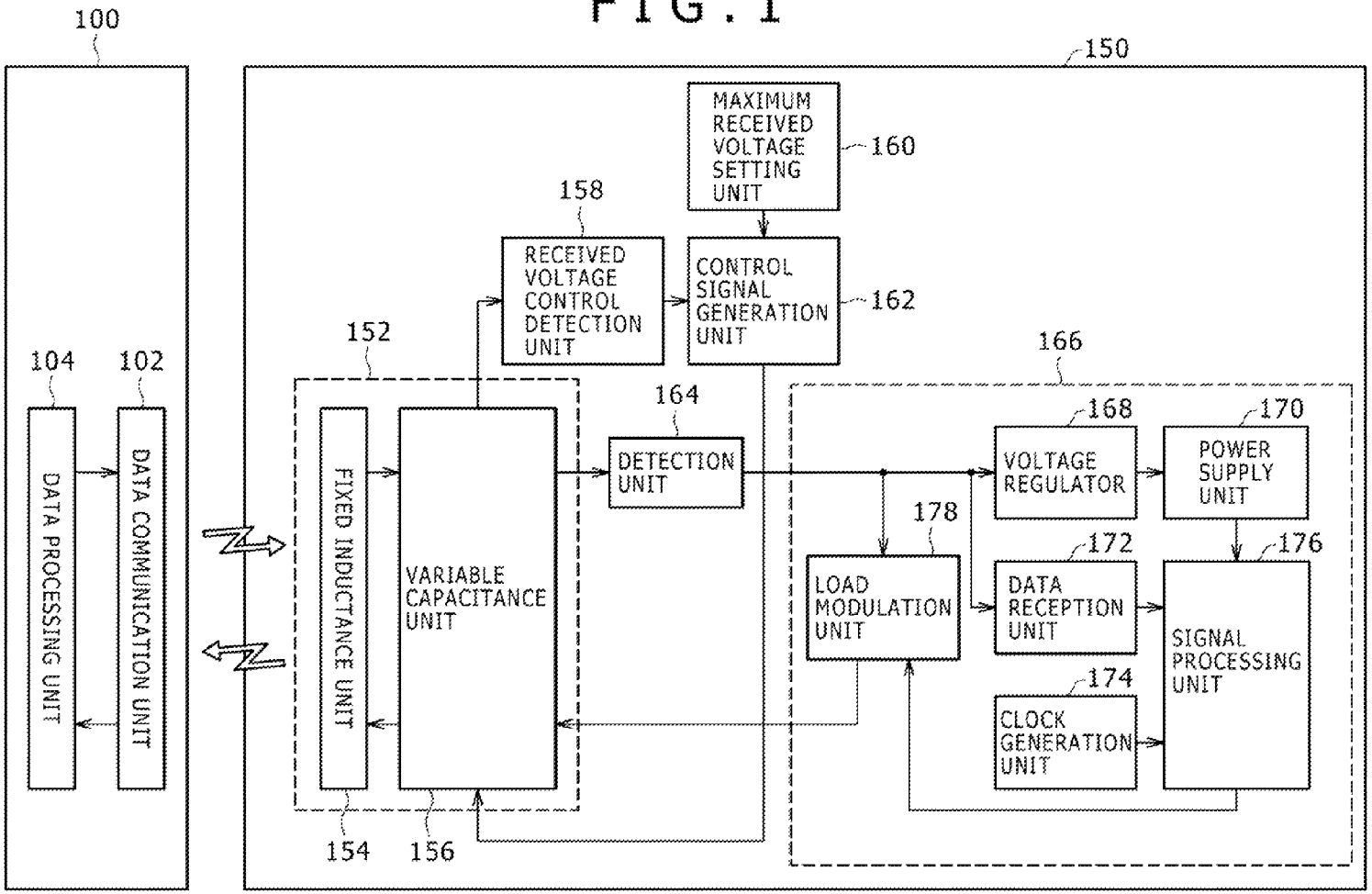
FIG. 1 is a block diagram of a communication system made up of a reader/writer and an information processing terminal according to a first embodiment of the present invention.

Preferred embodiments of the present invention will now be described in reference to the accompanying drawings. In the specification that follows and in the attached drawings, like reference characters will designate like or corresponding parts and their descriptions will be omitted where redundant.

(Problems with the Information Processing Terminal in Related Art)

Figure 10:
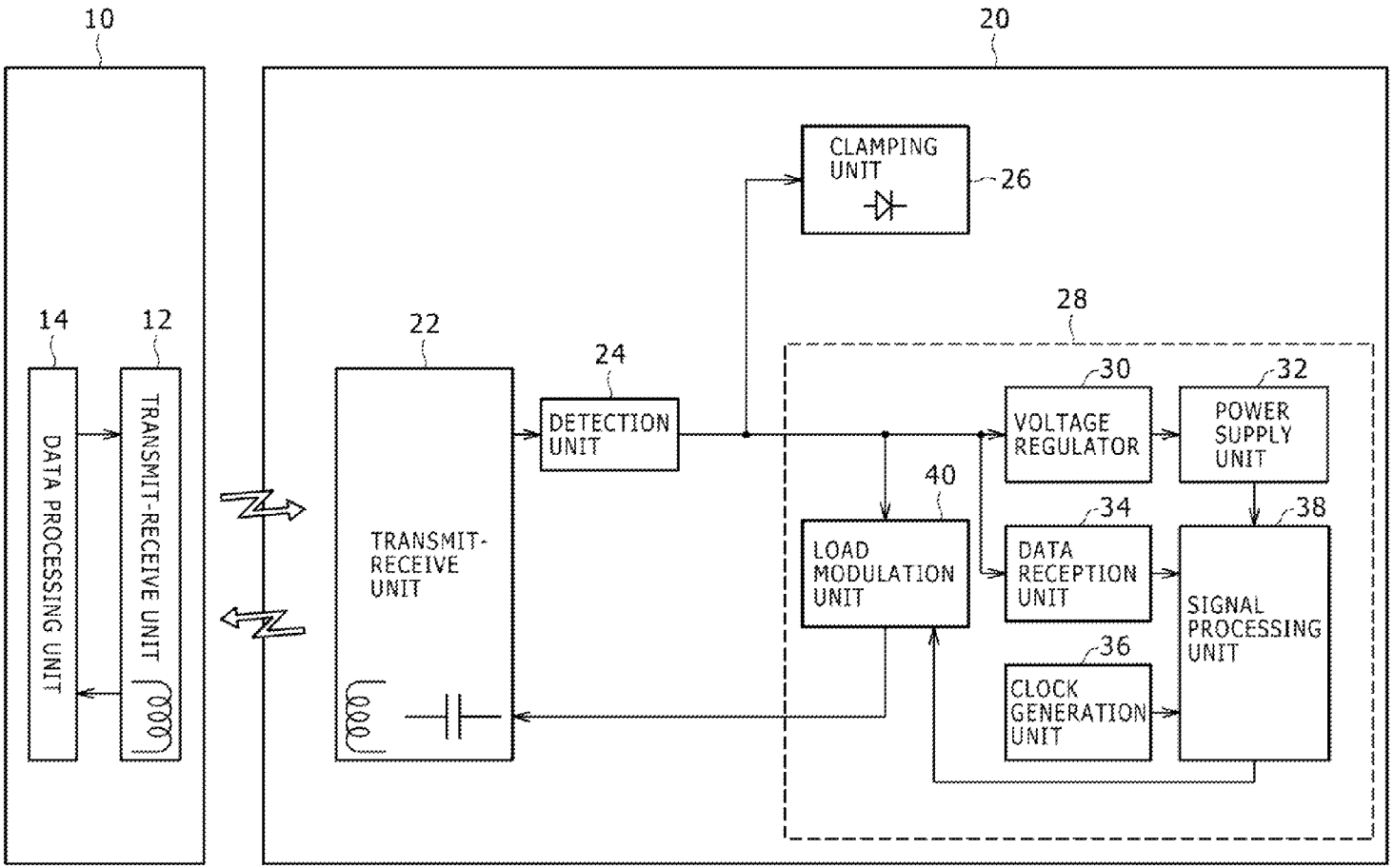
FIG. 10 is a block diagram of a communication system made up of a reader/writer in related art and an information processing terminal in related art.

What follows is an explanation of some of the problems with the communication between a reader/writer in related art and an information processing terminal in related art. FIG. 10 is a block diagram of a communication system made up of a reader/writer 10 in related art and an information processing terminal 20 in related art.

Referring to FIG. 10, the reader/writer 10 in related art at least includes a transmit-receive unit 12 and a data processing unit 14. The transmit-receive unit 12 transmits data and power generated within the reader/writer 10 to the information processing terminal 20 in related art. Illustratively, the transmit-receive unit 12 transmits a magnetic field of a particular frequency (e.g., 13.56 MHz) to the information processing terminal 20 and receives a response therefrom. The data processing unit 14 generates the data to be transmitted to the information processing terminal 20 and forwards the generated data to the transmit-receive unit 12. The data processing unit 14 may perform other processes in response to the kind of response received from the information processing terminal 20.

The information processing terminal 20 in related art is made up of a transmit-receive unit 22, a detection unit 24, a clamping unit 26, and a transmit-receive processing section 28. The transmit-receive unit 22 is a resonance circuit constituted by a coil that acts as a transmit-receive antenna having a fixed inductance and by a capacitor having a fixed capacitance. In operation, the transmit-receive unit 22 outputs a received voltage obtained through resonance with the specific frequency used by the reader/writer 10 in related art for its carrier wave.

The detection unit 24 rectifies the received voltage. The clamping unit 26 serves as a protection circuit for the information processing terminal. The clamping unit 26 is formed by diodes in multiple stages and serves gradually to drop the received voltage as it rises to a predetermined threshold level and to cut the voltage above the threshold so that the withstand voltage range of the components in the transmit-receive processing section 28 will not be exceeded. The received voltage thus pruned is channeled to ground by the clamping unit 26. The received voltage is said to be "clipped" when dropped within the tolerable range and is said to be "clamped" when the excess voltage above the threshold is directed to ground.

The transmit-receive processing section 23 is made up of a voltage regulator 30, a power supply unit 32, a data reception unit 34, a clock generation unit 36, a signal processing unit 38, and a load modulation unit 40. The voltage regulator 30 smoothes the received voltage into a steady voltage. The steady voltage smoothed by the voltage regulator 30 is input to the power supply unit 32 which in turn outputs a drive voltage for driving the information processing terminal 20 in related art. The data reception unit 34 amplifies the received voltage so as to output a binarized data signal that goes either High or Low. The clock generation unit 36 generates a rectangular wave clock signal. The signal processing unit 38 is driven by the drive voltage and, based on the data signal and clock signal, outputs a binarized response signal that goes either High or Low. The load modulation unit 40 performs a load modulation process in accordance with the response signal.

The load modulation performed by the load modulation unit 40 causes the impedance of the information processing terminal 20 in related art to vary from the viewpoint of the reader/writer 10 in related art. The variable impedance of the information processing terminal 20 as viewed from the reader/writer 10 may be regarded as a signal directed at the reader/writer 10.

Figure 11:
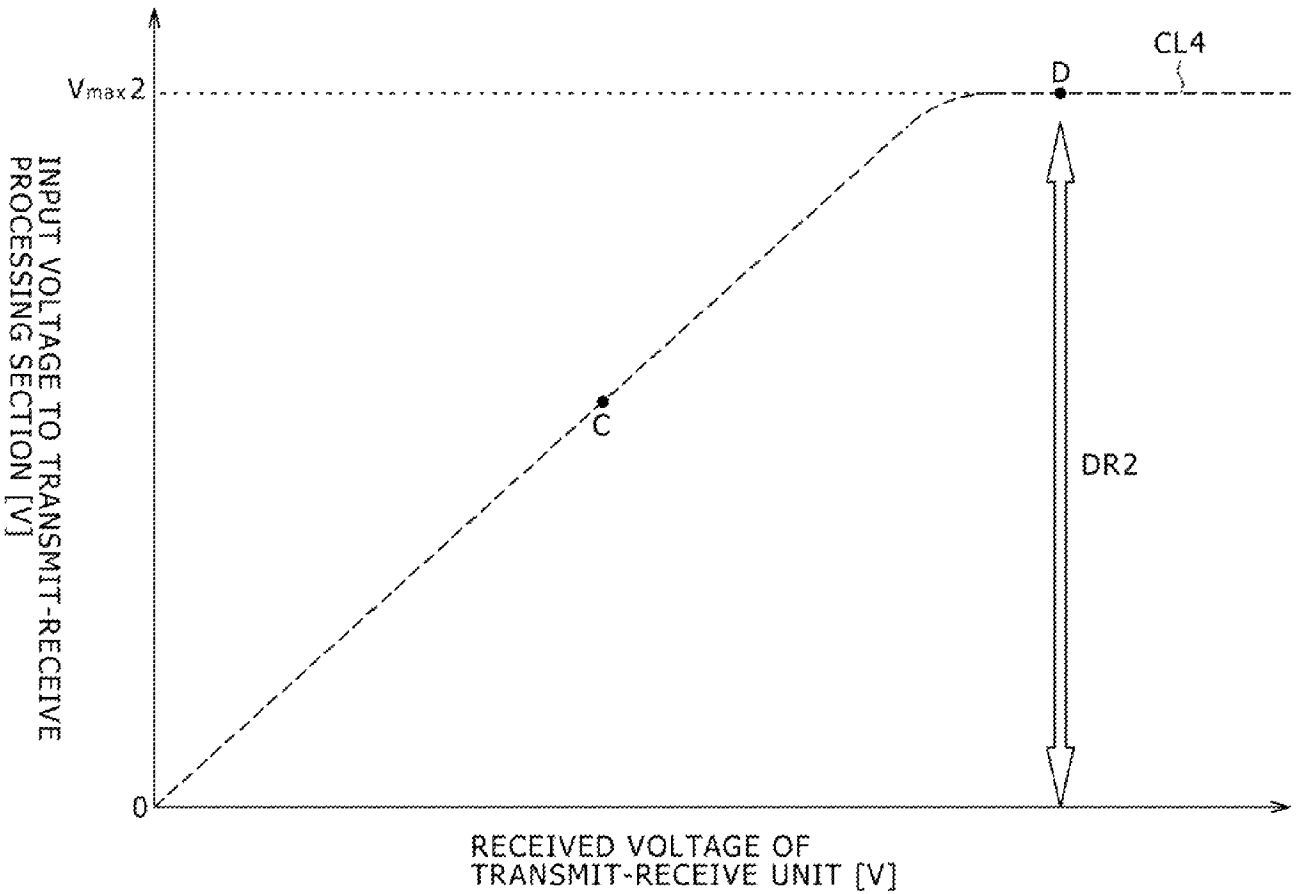
FIG. 11 is a graphic representation explanatory of typical relations between the received voltage and the input voltage to the transmit-receive processing section in the information processing terminal in related art.
Figure 12B:
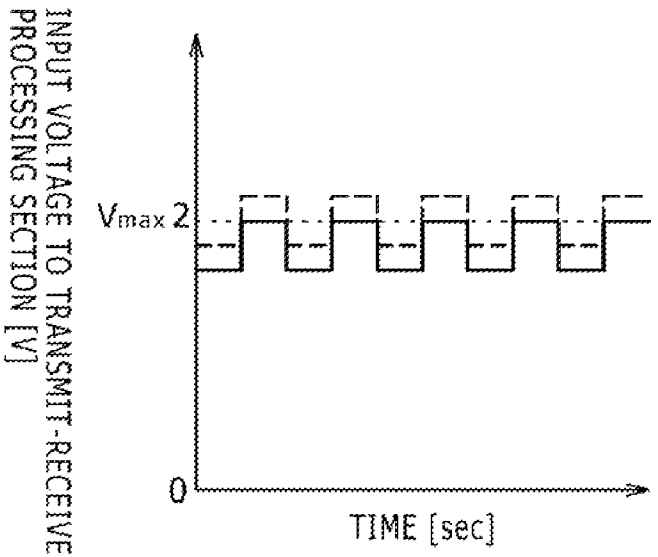
FIGS. 12A and 12B are graphic representations explanatory of comparisons at point D in FIG. 11 between the received voltage and the input voltage to the transmit-receive processing section in the information processing terminal in related art.
Figure 12A:
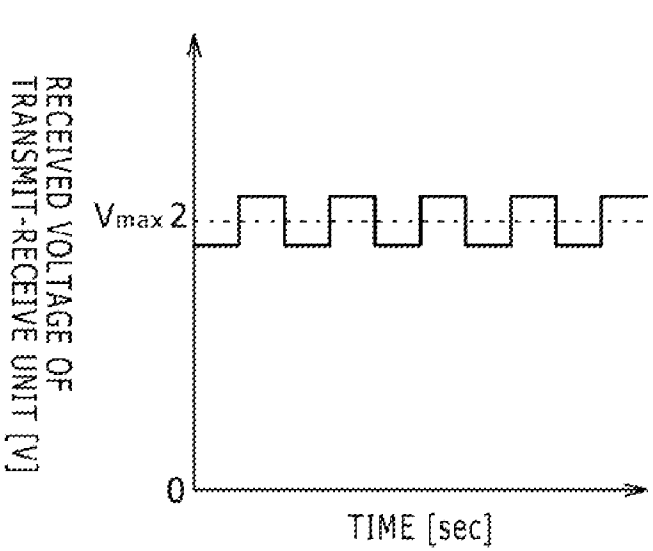

Major problems with the information processing terminal 20 in related art of the above-described structure are explained below with reference to FIGS. 11 through 13. FIG. 11 is a graphic representation explanatory of typical relations between the received voltage of the transmit-receive unit 22 and the input voltage to the transmit-receive processing section 28 in the information processing terminal 20 in related art. FIGS. 12A and 12B are graphic representations explanatory of comparisons at point D in FIG. 11 between the received voltage of the transmit-receive unit 22 and the input voltage to the transmit-receive processing section 28. More specifically, FIG. 12A graphically shows the received voltage that is output by the transmit-receive unit 22 while FIG. 12B indicates the voltage that is input to the transmitter-receiving processing unit 28.

Figure 13B:
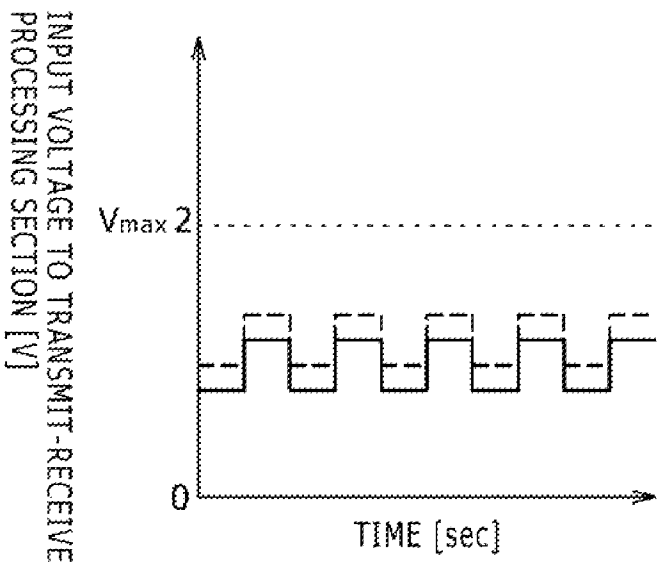
FIGS. 13A and 13B are graphic representations explanatory of comparisons at point C in FIG. 11 between the received voltage and the input voltage to the transmit-receive processing section in the terminal in related art.
Figure 13A:
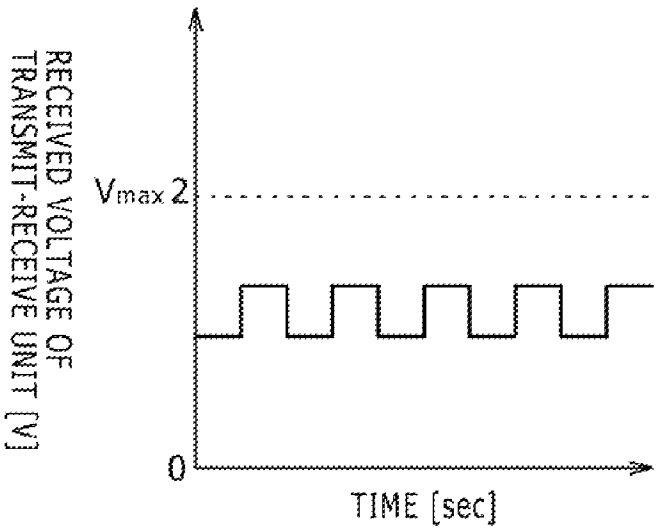

FIGS. 13A and 13B are graphic representations explanatory of comparisons at point C in FIG. 11 between the received voltage of the transmit-receive unit 22 and the input voltage to the transmit-receive processing section 28. More specifically, FIG. 13A graphically shows the received voltage that is output by the transmit-receive unit 22 and FIG. 13B illustrates the voltage that is input to the transmit-receive processing section 28.

The higher the received voltage, the more elevated the voltage input to the transmit-receive processing section 28. Above a predetermined voltage value Vmax2, the input voltage is clipped. Consequently, as shown in FIG. 11, the relationship between the received voltage and the input voltage to the transmit-receive processing section 28 is typically represented by a curve CL4. The transmit-receive processing section 28 has a dynamic range DR2 that encompasses the voltage value Vmax2.

Attention is drawn to point D at which the voltage input to the transmit-receive processing section 28 is clipped at the voltage level Vmax2 by the clamping unit 26. FIG. 12A graphically shows the received voltage before it is clipped, while FIG. 12B illustrates the received voltage after it is clipped by the clamping unit 26 and thereby lowered in level.

Attention is now drawn to point C at which the voltage input to the transmit-receive processing section 28 is smaller than the voltage value Vmax2. As described above, the diodes in multiple stages making up the clamping unit 26 serve gradually to clip the received voltage as it rises to the threshold level. For that reason, although the received voltage value at point C falls within the dynamic range DR2 as shown in FIG. 13A, the voltage input to the transmit-receive processing section 28 turns out to be still lower as indicated in FIG. 13B.

Where the received voltage is relatively low, the information processing terminal 20 in related art thus reduces on its own initiative the voltage entering the transmit-receive processing section 28. This shortens the distance in which the reader/writer 10 in related art and the information processing terminal 20 in related art can normally communicate with each other. In other words, the information processing terminal 20 cannot communicate correctly with the reader/writer 10 unless it comes much closer to the latter than usual.

The clamping unit 26 clips and clamps the received voltage obtained by the transmit-receive unit 22 amplifying the carrier wave coming from the reader/writer 10 in related art. The higher the received voltage, the more elevated the voltage to be clamped by the clamping unit 26. The clamped portion of the voltage is discharged as thermal energy. That is, the information processing terminal 20 in related art produces unnecessary heat corresponding to the clamped voltage portion. This problem persists even if the clamping unit 26 is formed not by diodes in multiple stages but by, say, a Zener diode which does not gradually lower the received voltage before it reaches a threshold level but which clips only the voltage portion exceeding the threshold.

In addition, the information processing terminal 20 in related art processes data coming from the reader/writer 10 in related art using the voltage acquired by clipping and clamping the received voltage derived from amplification of the carrier wave from the reader/writer 10. As mentioned above, the unnecessary heat generated by the information processing terminal 20 in related art because of the clamped voltage portion imposes a limit on the voltage level that may be clamped. That means the information processing terminal 20 needs to have a more extensive dynamic range DR2 than usual.

As explained above, the information processing terminal in related art incorporating the clamping unit as a protection circuit is subject to diverse problems including the reduced distance for normal communication between the terminal and the reader/writer, unnecessary heat generation, and wider dynamic range than before. The present invention envisages resolving such problems through some of its preferred embodiments to be described below in detail.

First Embodiment

Figure 2:
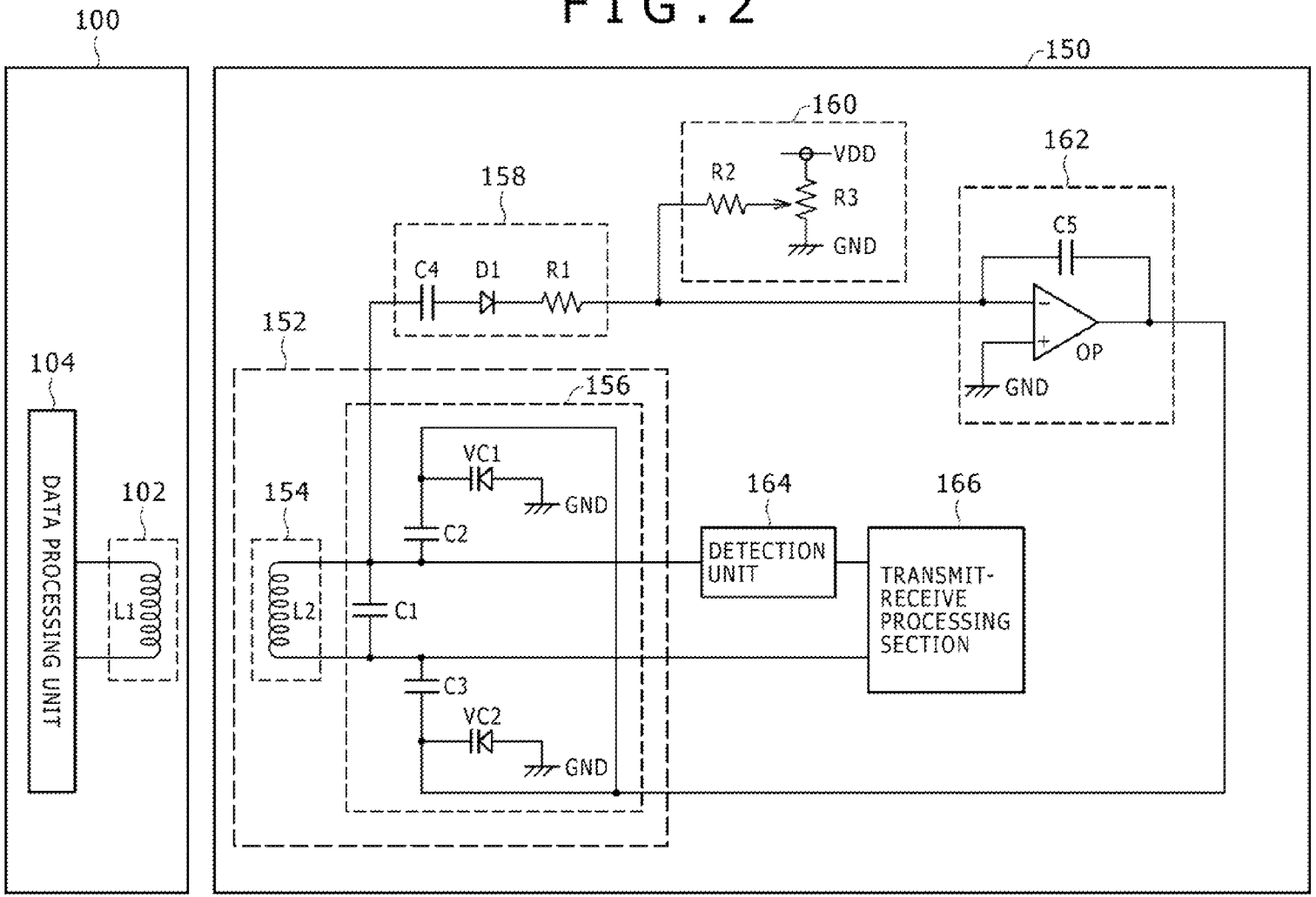
FIG. 2 is a schematic circuit diagram of the communication system constituting the first embodiment including the reader/writer and information processing terminal.

FIG. 1 is a block diagram of a communication system made up of a reader/writer 100 and an information processing terminal 130 according to the first embodiment of the present invention. FIG. 2 is a schematic circuit diagram of the communication system constituting the first embodiment including the reader/writer 100 and information processing terminal shown in FIG. 1.

Referring to FIG. 1, the reader/writer 100 of the first embodiment has at least a data communication unit 102 and a data processing unit 104. The data communication unit 102 emits a carrier wave that transports to the information processing terminal 150 the data and power generated inside the reader/writer 100, and receives responses from the information processing terminal 150. The data processing unit 104 creates data to be transmitted to the information processing terminal 150, forwards the created data to the data communication unit 102, and performs various processes in accordance with the response from the information processing terminal 150.

Although FIG. 1 shows only the data communication unit 102 and data processing unit 104, this is not limitative of the present invention. Alternatively, there may be provided an interface operating in conjunction with a separate computer, not shown, to process data received by the data communication unit 102.

The information processing terminal 150 is made up of a resonance circuit section 152, a received voltage control detection unit 158, a maximum received voltage setting unit 160, a control signal generation unit 162, a detection unit 164, and a transmit-receive processing section 166. The resonance circuit section 152 is formed by a fixed inductance unit 154 and a variable capacitance unit 156. The fixed inductance unit 154 has a fixed inductance, receives the carrier wave from the reader/writer 100, and produces an induced voltage through electromagnetic inductance. The variable capacitance unit 156 is capable of varying its capacitance in accordance with a control signal, to be discussed later. Thus structured, the resonance circuit 152 outputs a received voltage obtained by causing the induced voltage to resonate with a given resonance frequency within a predetermined range.

The received voltage control detection unit 158 rectifies the received voltage coming from the resonance circuit 152. The received voltage control detection unit 158 further detects the received voltage. The maximum received voltage setting unit 160 outputs a reference voltage for defining maximum power of received voltage coming from the resonance circuit 152, that is, maximum power that can be obtained by the information processing terminal 150 from the reader/writer 100. Based on the received voltage thus rectified and on the reference voltage, the control signal generation unit 162 outputs the control signal for varying the capacitance of the variable capacitance unit 156. When the received voltage is relatively low, the control signal is gradually raised; where the received voltage is relatively high, the control signal is also raised progressively.

The defection unit 164 rectifies the received voltage coming from the resonance circuit section 152. Although FIG. 1 shows the received voltage control detection unit 158 and detection unit 164 as separate components, this is not limitative of the present invention. Obviously, the received voltage control detection unit 158 and detection unit 164 may be implemented integrally by a single component.

The transmit-receive processing section 166 includes a voltage regulator 168, a power supply unit 170, a data reception unit 172, a clock generation unit 174, a signal processing unit 176, and a load modulation unit 178. The voltage regulator 168 smoothes the received voltage into a steady voltage. The voltage smoothed by the voltage regulator 168 into the steady voltage is input to the power supply unit 170 which in turn outputs a drive voltage for driving the information processing terminal 150. The data reception unit 172 amplifies the received voltage so as to output a binarized data signal that goes either High or Low. The clock generation unit 174 generates a rectangular wave clock signal. The signal processing unit 176 is driven by the drive voltage and, based on the data signal and clock signal, outputs a binarized response signal that goes either High or Low. The load modulation unit 178 performs a load modulation process in accordance with the response signal.

The load modulation performed by the load modulation unit 178 causes the impedance of the information processing terminal 150 to vary from the viewpoint of the reader/writer 100. The variable impedance of the information processing terminal 150 as viewed from the reader/writer 100 may be regarded as a signal directed at the reader/writer 100.

How the received voltage is controlled by the information processing terminal 150 is described below by referring to FIG. 2.

Coming into a magnetic field generated by a coil L1 of the data communication unit 102 in the reader/writer 100 causes a coil L2 of the fixed inductance unit 154 in the information processing terminal 150 to develop an induced voltage through electromagnetic induction. The resonance circuit section 152 is constituted by the coil L2, by capacitors C1, C2 and C3 having a predetermined capacitance each, and by variable capacitors VC1 and VC2 with a variable capacitance each, the capacitors making up the variable capacitance unit 156. The resonance circuit section 152 outputs the received voltage obtained by causing the induced voltage to resonate with a given resonance frequency within a predetermined range. Besides being structured as described above, the variable capacitance unit 156 may also be formed by a device capable of varying its capacitance linearly.

The received voltage is deprived of its DC (direct current) component by a capacitor C4 before being rectified by a diode D1 in the received voltage control detection unit 158. A resistor R1, another component of the received voltage control detection unit 156, will be discussed later. The maximum received voltage setting unit 160 outputs a reference voltage obtained by dividing a voltage VDD using a resistor R3. Another resistor R2 in the maximum received voltage setting unit 160 works to match the line with the voltage level out of the received voltage control detection unit 158. The reference voltage that defines a maximum received voltage beforehand may be established in advance using the voltage VDD and the resistor R3. The voltage VDD may be supplied either from inside the power supply unit 170 or from an internal. power source, not shown, provided separately by the information processing terminal 150.

The control signal generation unit 162 is an integrator that outputs the control signal obtained by integrating the received voltage with the reference voltage using a time constant commensurate with a capacitor C5 and the resistors R1 and R2. The control signal output by the control signal generation unit 162 is used to control the variable capacitors VC1 and VC2 in the variable capacitance unit 156. Given the control signal, the variable capacitors VC1 and VC2 vary their capacitance linearly.

As described, the information processing terminal 150 of the first embodiment linearly changes the resonance frequency by causing the variable capacitance unit 156 to vary its capacitance linearly based on the control signal derived from the received voltage output by the resonance circuit 152 and from the reference voltage for defining the maximum received voltage beforehand.

The resonance frequency is changed as follows: when the received voltage detected as described is relatively high, i.e., when the reader/writer 100 is close to the information processing terminal 150 upon communication, the resonance frequency is deliberately shifted from the particular frequency of the carrier wave in order to reduce reception sensitivity. When the detected received voltage is relatively low, i.e., when the reader/writer 100 is far away from the information processing terminal 150 upon communication, resonance is arranged to occur at the specific frequency of the carrier wave so as to maximize reception frequency.

Figure 3:
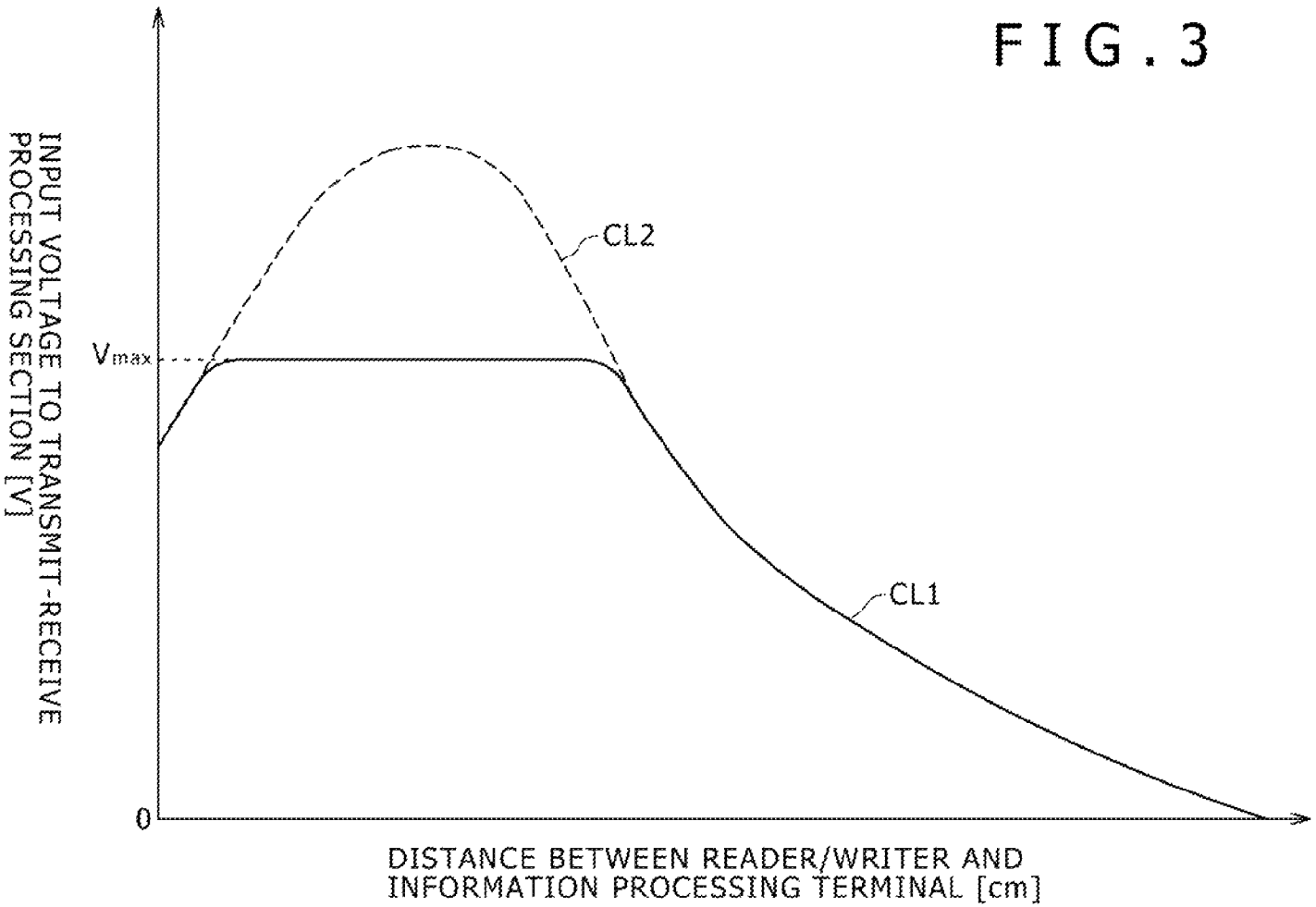
FIG. 3 is a graphic representation explanatory of typical relations between the distance between the reader/writer and information processing terminal of the first embodiment on the one hand, and the input voltage to a transmit-receive processing section in the information processing terminal on the other hand.

FIG. 3 is a graphic representation explanatory of typical relations between the distance between the reader/writer 100 and information processing terminal 150 of the first embodiment on the one hand, and the input voltage to the transmit-receive processing section 166 in the information processing terminal 150 on the other hand. A curve CL1 indicates how the input voltage to the transmit-receive processing section 166 in the information processing terminal 150 of the first embodiment varies in relation to the distance between the reader/writer 100 and the information processing terminal 150. A curve CL2 depicts how the input voltage (not clamped) to the transmit-receive processing section 166 of the information processing terminal 150 varies relative to the distance between the reader/writer 100 and the terminal 150 during continuous resonance with the particular frequency of the carrier wave.

When the reader/writer 100 is located close to the information processing terminal 150 of the first embodiment upon communication, the input voltage to the transmit-receive processing section 166 does not exceed a predetermined voltage value Vmax as shown by the curve CL1 in FIG. 3. That is because resonance is not allowed to occur at the specific frequency of the carrier wave.

When the reader/writer 100 is located far away from the information processing terminal 150 of the first embodiment upon communication, the input voltage to the transmit-receive processing section 166 still remains substantially the same as evidenced by the curves CL1 and CL2. That is because resonance is allowed to occur in this case at the particular frequency of the carrier wave.

Thus when necessary and sufficient power is obtained from the reader/writer 100 by having the resonance frequency varied linearly within the predetermined range, the information processing terminal 150 of the first embodiment does not amplify the induced voltage at the particular frequency used as the carrier wave; when necessary and sufficient power is not acquired from the reader/writer 100, the information processing terminal 150 maximizes the received voltage by amplifying the induced voltage at the specific frequency of the carrier wave. In this manner, the information processing terminal 150 of the first embodiment can operate stably regardless of the received voltage level by getting the resonance frequency varied linearly within the predetermined range.

Figure 4:
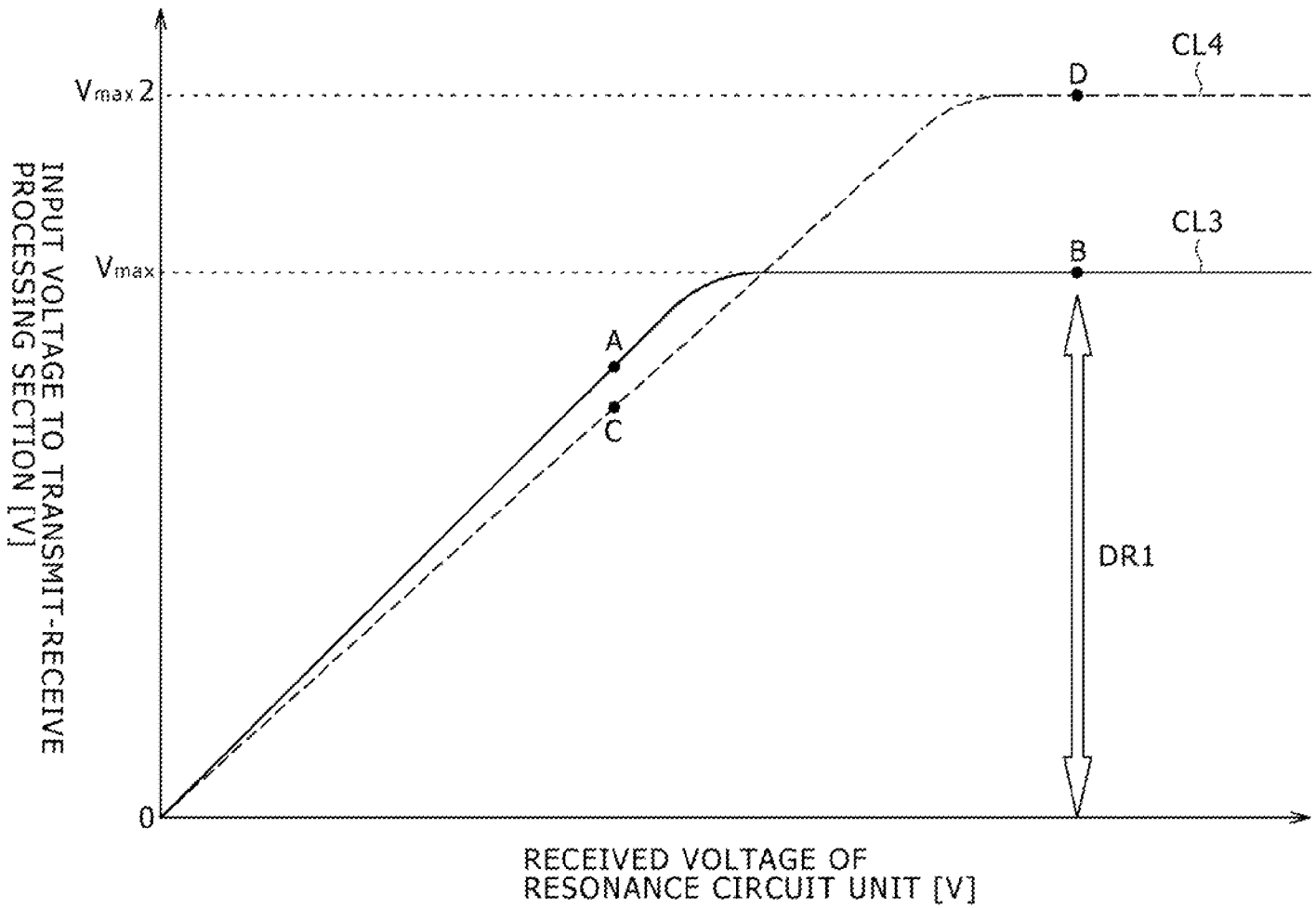
FIG. 4 is a graphic representation explanatory of typical relations between the received voltage of the information processing terminal of the first embodiment and of an information processing terminal in related art on the one hand, and the input voltage to the transmit-receive processing section in the inventive and the terminals in related art on the other hand.

FIG. 4 is a graphic representation explanatory of typical relations between the received voltage of the information processing terminal 150 of the first embodiment and of the information processing terminal 20 in related art on the one hand, and the input voltage to the transmit-receive processing section in the inventive and the terminals in related art on the other hand. A curve CL3 depicts relations between the received voltage and the input voltage to the transmit-receive processing section 166 in the information processing terminal 150 of the first embodiment. A curve CL4 denotes relations between the received voltage and the input voltage to the transmit-receive processing section 28 in the information processing terminal 20 in related art shown in FIG. 10.

Figure 5B:
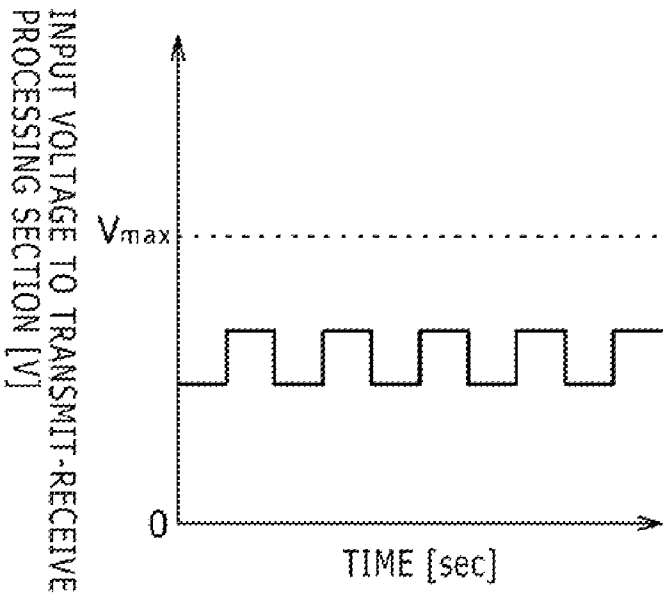
FIGS. 5A and 5B are graphic representations explanatory of comparisons at point A in FIG. 4 between the received voltage and the input voltage to the transmit-receive processing section in the inventive information processing terminal.
Figure 5A:
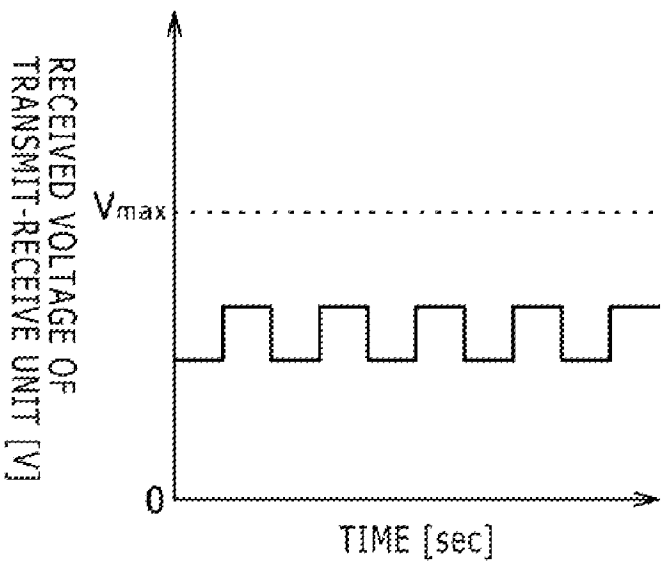

FIGS. 5A and 5B are graphic representations explanatory of comparisons at point A in FIG. 4 between the received voltage and the input voltage to the transmit-receive processing section 166 in the inventive information processing terminal. More specifically, FIG. 5A depicts the received voltage that is output by the resonance circuit section 152, and FIG. 6B indicates the voltage that is input to the transmit-receive processing section 166.

Figure 6B:
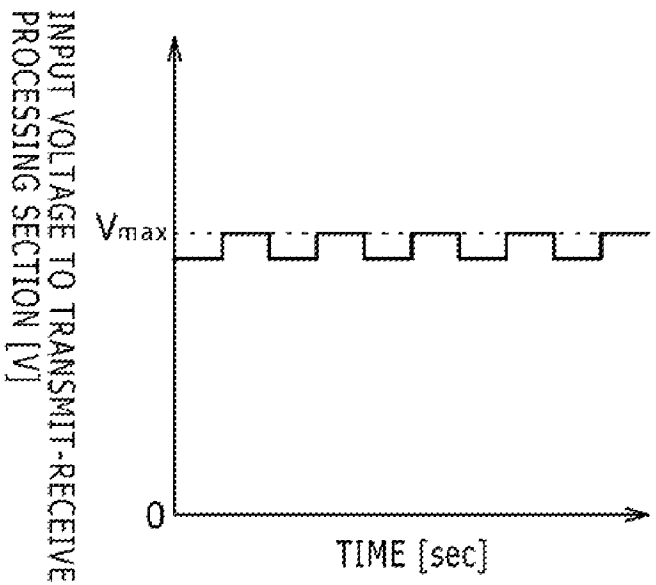
FIGS. 6A and 6B are graphic representations explanatory of comparisons at point B in FIG. 4 between the received voltage and the input voltage to the transmit-receive processing section in the information processing terminal in related art.
Figure 6A:
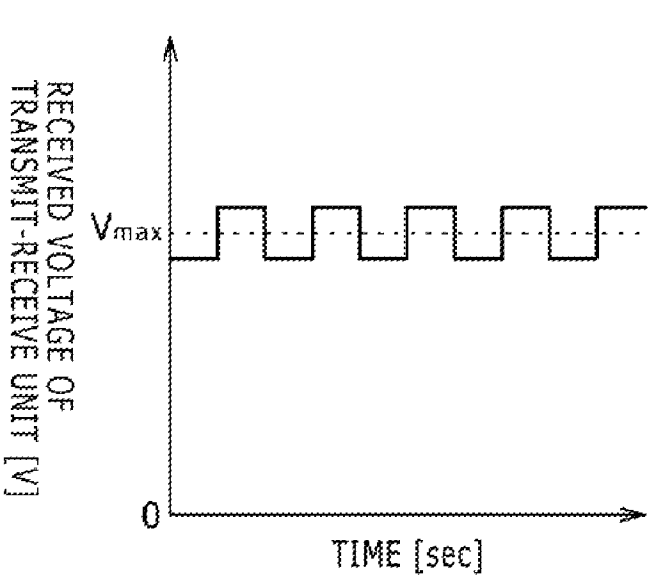

FIGS. 6A and 6B are graphic representations explanatory of comparisons at point B in FIG. 4 between the received voltage and the input voltage to the transmit-receive processing section 166 in the information processing terminal in related art. More specifically, FIG. 6A depicts the received voltage that is output by the resonance circuit section 152, and FIG. 6B denotes the voltage that is input to the transmit-receive processing section 166.

From FIG. 4, it can be seen that when the received voltage is relatively low (e.g., at points A and C), the voltage entering the transmit-receive processing section is higher in the information processing terminal 150 of the first embodiment than in the information processing terminal 20 in related art. That is because the information processing terminal 20 in related art has the received voltage clamped by the clamping unit 26 while the inventive information processing terminal 150 does not have the received voltage clamped. As shown in FIGS. 5A and 5B, the received voltage is thus input undiminished to the transmit-receive processing section 166.

Consequently, the information processing terminal 150 of the first embodiment can utilize with little waste the received voltage as the voltage to be input to the transmit-receive processing section 166. Unlike the information processing terminal 20 in related art, the inventive terminal 150 does not need shorter distances in performing normal communication.

It can also be seen that when the received voltage is relatively high (e.g., at points B and D), the voltage entering the transmit-receive processing section is higher in the information processing terminal 20 in related art than in the information processing terminal 150 of the first embodiment. That is attributable to the difference in structure between the information processing terminal 20 in related art and the inventive information processing terminal 150. More specifically, the information processing terminal 20 in related art is designed to clip at the voltage value Vmax2 the received voltage amplified through resonance with the particular frequency of the carrier wave. In order to reduce heat generation, the information processing terminal 20 in related art needs to raise the voltage value Vmax2 to some extent in keeping with the dynamic range DR2 . By contrast, the information processing terminal 150 of the first embodiment dispenses with resonance with the particular frequency of the carrier wave so as not to exceed the predetermined voltage value Vmax, as shown in FIGS. 6A and 6B. This makes it possible for the information processing terminal 150 to minimize the voltage value Vmax corresponding to a dynamic range DR1 .

As a result, the information processing terminal 150 of the first embodiment can be formed by the components offering the dynamic range DR1 commensurate with the predetermined voltage value Vmax that is lower than the voltage value Vmax2 corresponding to the dynamic range DR2 of the information processing terminal 20 in related art. Obviously, the voltage value Vmax can be set beforehand to be equal to or higher than the voltage value Vmax2.

As described, if necessary and sufficient power is obtained from the reader/writer 100 by having the resonance frequency varied linearly within the predetermined range, then the information processing terminal 150 of the first embodiment does not amplify the induced voltage at the particular frequency used as the carrier wave; when necessary and sufficient power is not acquired from the reader/writer 100, the information processing terminal 150 maximizes the received voltage by amplifying the induced voltage at the specific frequency of the carrier wave. Thus the information processing terminal 150 of the first embodiment can operate stably regardless of the received voltage level by having the resonance frequency varied linearly within the predetermined range.

The information processing terminal 150 of the first embodiment can drive the transmit-receive processing section 166 without clipping or clamping the received voltage. That means the inventive terminal 150 can utilize more efficiently the magnetic field energy emitted by the reader/writer 100 than the information processing terminal 20 in related art shown in FIG. 10.

Furthermore, the information processing terminal 150 does not generate unnecessary heat because it does not clip or clamp the received voltage.

Although the first embodiment of the present invention was shown applied to the information processing terminal 150 above, this is not limitative of the present invention. Alternatively, the first embodiment may also be applied extensively to portable communication apparatuses such as mobile phones equipped with IC cards, RFID tags and/or IC card chips, as well as to computers such as PDA (personal digital assistant) incorporating IC card chips.

Many IC cards do not have built-in power supplies and utilize instead magnetic field energy coming from the reader/writer for their operation. To stabilize communication between the reader/writer and an IC card thus typically requires ensuring a stable power source that drives the IC card. When the first embodiment above is applied to the IC card, the IC card can secure stable power to drive itself. This enables the IC card to operate stably regardless of the received voltage being high or low.

Whereas internal power sources are provided in many portable communication devices such as mobile phones and PHS incorporating IC card chips as well as in many computers such as PDA furnished with IC card chips, the portable communication apparatus of this invention can gain stable power supply from the reader/writer and utilize the received voltage to drive itself. That means the portable communication apparatus of the present invention reduces consumption of its internal power supply and thereby preserves its power level. Furthermore, the inventive portable communication apparatus can function even if its internal power level is not sufficient to drive itself.

Second Embodiment

In the foregoing description, the information processing terminal 150 of the first embodiment was shown to vary capacitance so as to vary resonance frequency linearly. However, adopting the first embodiment is not limited to the way of linearly varying the resonance frequency. An alternative is described below in the form of an information processing terminal 250 as the second embodiment of the present invention.

Figure 7:
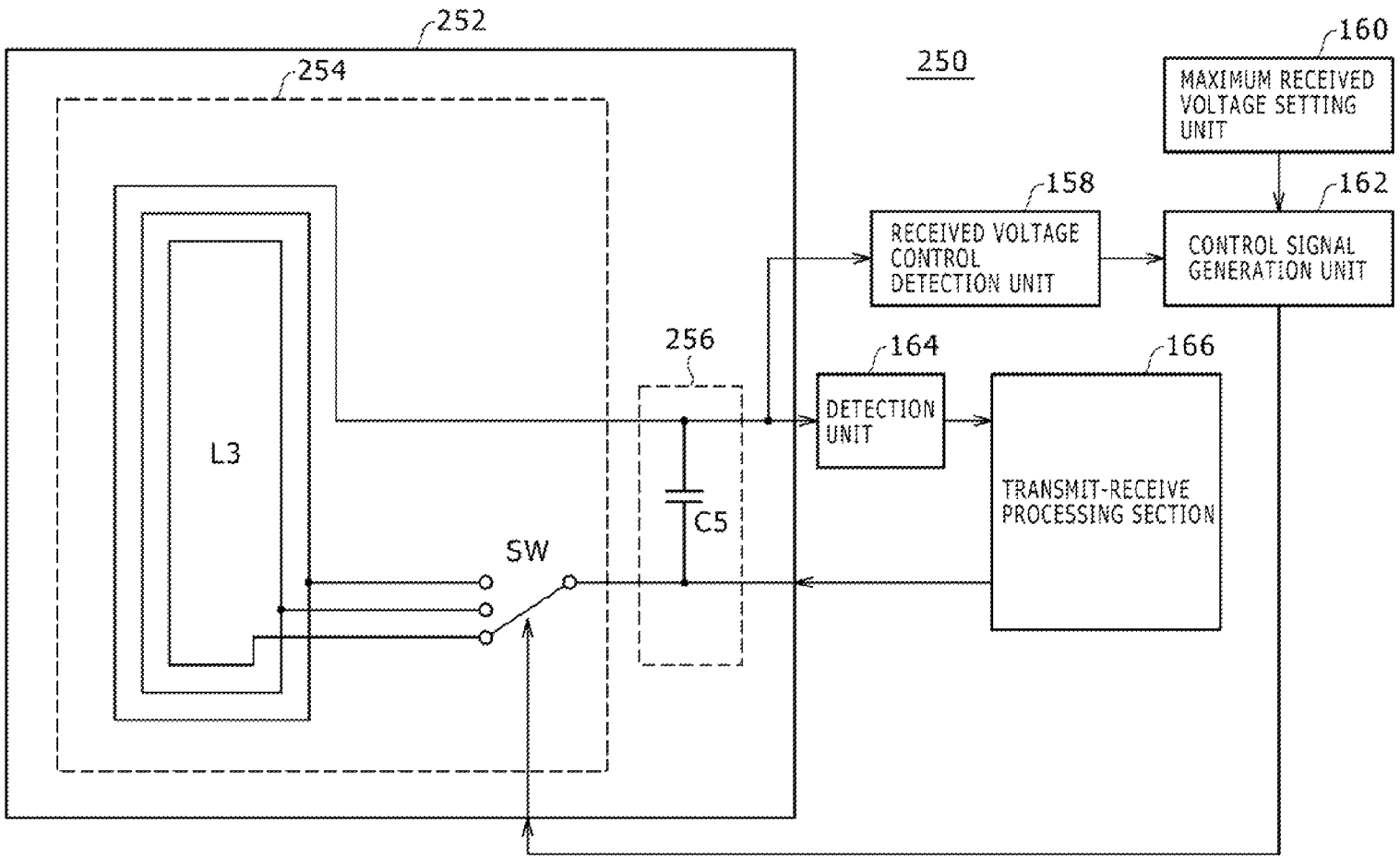
FIG. 7 is a schematic view explanatory of an information processing terminal according to a second embodiment of the present invention.

FIG. 7 is a schematic view explanatory of the information processing terminal 250 according to the second embodiment of the present invention.

Referring to FIG. 7, a resonance circuit section 252 in the information processing terminal 250 of the second embodiment is shown to be different in structure from the resonance circuit section 152 in the information processing terminal 150 of the first embodiment in FIG. 2.

The resonance circuit section 252 is includes a variable inductance unit 254 and a fixed capacitance unit 256. The variable inductance unit 254 is formed by a coil L3 and a switch SW capable of varying the number of turns on the coil L3 in accordance with a control signal. Through electromagnetic induction, the variable inductance unit 254 produces an induced voltage reflecting the inductance in effect. The fixed capacitance unit 256 includes a capacitor C5 having a fixed capacitance. The resonance circuit section 252 includes the variable inductance unit 254 and fixed capacitance unit 256, outputs the received voltage obtained by getting the induced voltage to resonate with a given resonance frequency within a predetermined range.

Thus the major difference between the information processing terminal 150 of the first embodiment and the information processing terminal 250 of the second embodiment is whether the resonance frequency is varied by having the capacitance changed in keeping with the control signal (as in the case of the first embodiment) or by getting the inductance changed in accordance with the control signal (as in the case of the second embodiment). Accordingly, the information processing terminal 250 of the second embodiment provides substantially the same effects as the information processing terminal 150 of the first embodiment.

The variable inductance unit 254 in FIG. 7 varies its inductance illustratively by having the switch SW operated in three steps. Alternatively, if the resolution of the switch SW is made sufficiently high, the resonance frequency can be varied linearly.

It is also possible for the variable inductance unit 254 to adopt not the switch SW but, say, a needle arrangement moving over the turns of the coil to vary the inductance linearly. Obviously, the variable inductance unit 254 may be structured in any other suitable way as long as it can vary the inductance linearly or in an approximately linear manner.

Thus when necessary and sufficient power is obtained from the reader/writer by having the resonance frequency varied linearly within the predetermined range, the information processing terminal 250 of the second embodiment does not amplify the induced voltage at the particular frequency used as the carrier wave; when necessary and sufficient power is not acquired from the reader/writer, the information processing terminal 250 maximizes the received voltage by amplifying the induced voltage at the specific frequency of the carrier wave. Consequently, the information processing terminal 250 of the second embodiment can operate stably regardless of the received voltage level by having the resonance frequency varied linearly within the predetermined range.

The information processing terminal 250 of the second embodiment can drive the transmit-receive processing section 166 without clipping or clamping the received voltage. That means the information processing terminal 250 can utilize more efficiently the magnetic field energy emitted by the reader/writer than the information processing terminal 20 in related art shown in FIG. 10.

Furthermore, the information processing terminal 250 does not generate unnecessary heat because it does not clip or clamp the received voltage.

Although the second embodiment of the present invention was shown applied to the information processing terminal 250 above, this is not limitative of the present invention. Alternatively, the second embodiment may also be applied extensively to portable communication apparatuses such as PHS equipped with IC cards and/or IC card chips or to computers such as UMPC (ultra mobile personal computer) incorporating IC card chips.

Third Embodiment

In the foregoing description, the information processing terminal 150 of the first embodiment and the information processing terminal 250 of the second embodiment were shown to vary resonance frequency linearly in keeping with the control signal. What follows is an explanation of an information processing terminal 350 of the third embodiment in which the arrangement for determining the maximum received voltage is modified.

Figure 8:
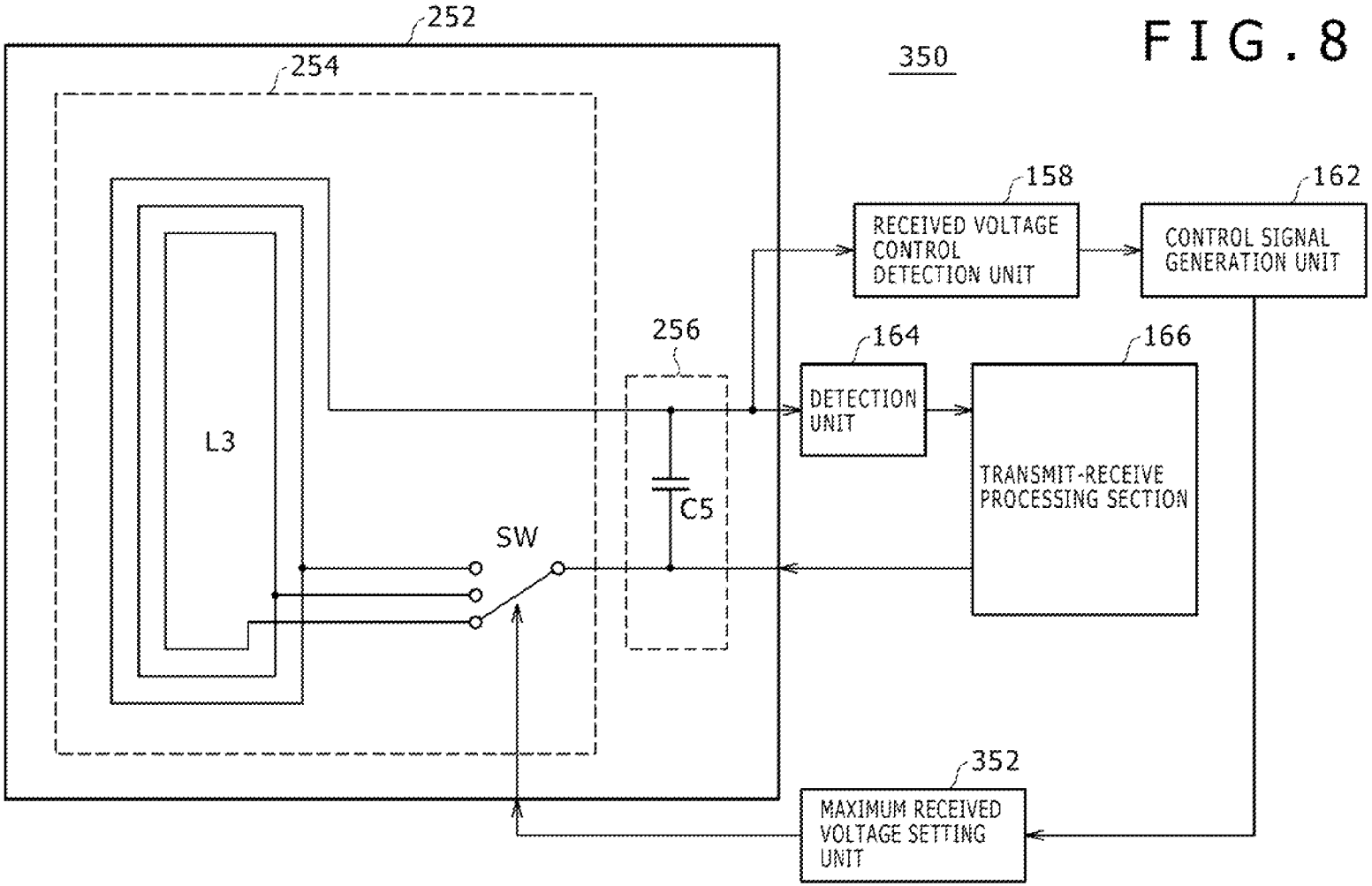
FIG. 8 is a schematic view explanatory of an information processing terminal according to a third embodiment of the present invention.

FIG. 8 is a schematic view explanatory of the information processing terminal 350 according to the third embodiment of the present invention.

From FIG. 8, it can be seen that the information processing terminal 350 of the third embodiment is basically the same in structure as the information processing terminal 250 of the second embodiment. It can also be seen that unlike in the information processing terminal 250 of the second embodiment, a maximum received voltage setting unit 352 is located not upstream but downstream of the control signal generation unit 162.

The received voltage is rectified by the received voltage control detection unit 158 before being integrated by the control signal generation unit 162 that has no maximum received voltage value established therein. The control signal generation unit 162 then sends its output voltage to the maximum received voltage setting unit 352 which in turn outputs a control signal together with a suitably defined maximum received voltage value.

In order to output the control signal together with the defined maximum received voltage value, the maximum received voltage setting unit 352 may use illustratively a differential amplifier that outputs a voltage proportionate to the difference between the reference voltage for defining the maximum received voltage value on the one hand and the output voltage from the control signal generation unit 162 on the other hand. Alternatively, the maximum received voltage setting unit 352 may output the control signal along with the defined maximum received voltage value through the use of a table that describes correspondence between the output voltage of the control signal generation unit 162 and the control signal. Obviously, the maximum received voltage setting unit 352 is not limited to the structures described above.

Although the information processing terminal 350 of the third embodiment differs from the information processing terminal 150 of the first embodiment and from the information processing terminal 250 of the second embodiment in terms of the arrangements for defining the maximum received voltage value, the information processing terminal 350 of the third embodiment can still vary the resonance frequency linearly in accordance with the control signal. On this account, the information processing terminal 350 of the third embodiment provides substantially the same effects as the information processing terminal 250 of the second embodiment.

Thus when necessary and sufficient power is obtained from the reader/writer by having the resonance frequency varied linearly within the predetermined range, the information processing terminal 350 of the third embodiment does not amplify the induced voltage at the particular frequency used as the carrier wave; when necessary and sufficient power is not acquired from the reader/writer, the information processing terminal 350 maximizes the received voltage by amplifying the induced voltage at the specific frequency of the carrier wave. Consequently, the information processing terminal 350 of the third embodiment can operate stably regardless of the received voltage level by having the resonance frequency varied linearly within the predetermined range.

The information processing terminal 350 of the third embodiment can drive the transmit-receive processing section 166 without clipping or clamping the received voltage. That means the inventive terminal 350 can utilize more efficiently the magnetic field energy emitted by the reader/writer than the information processing terminal 20 in related art shown in FIG. 10.

Furthermore, the information processing terminal 350 does not generate unnecessary heat because it does not clip or clamp the received voltage.

Although the third embodiment of the present-invention was shown applied to the information processing terminal 350 above, this is not limitative of the present invention. Alternatively, the third embodiment may also be applied extensively to portable communication apparatuses such as mobile phones equipped with IC cards and/or IC card chips or to electronic organizers incorporating IC card chips.

As described above, the information processing terminal of the first, the second, or the third embodiment of this invention can operate stably regardless of the received voltage level by varying the resonance frequency linearly within the predetermined range. Thus unlike the information processing terminal in related art, the information processing terminal of the first, the second, or the third embodiment is not subject to the worsened efficiency typical of conversion to the received voltage even if the environment has changed, such as when the communication distance between the reader/writer and the inventive information processing terminal is altered or when there exits an external impediment (e.g., an obstruction such as another information processing terminal) aversely affecting the communication between the reader/writer and the information processing terminal. The information processing terminal of the first, the second, or the third embodiment is therefore highly capable of communicating normally with the reader/writer.

(Received Voltage Controlling Method)

Figure 9:
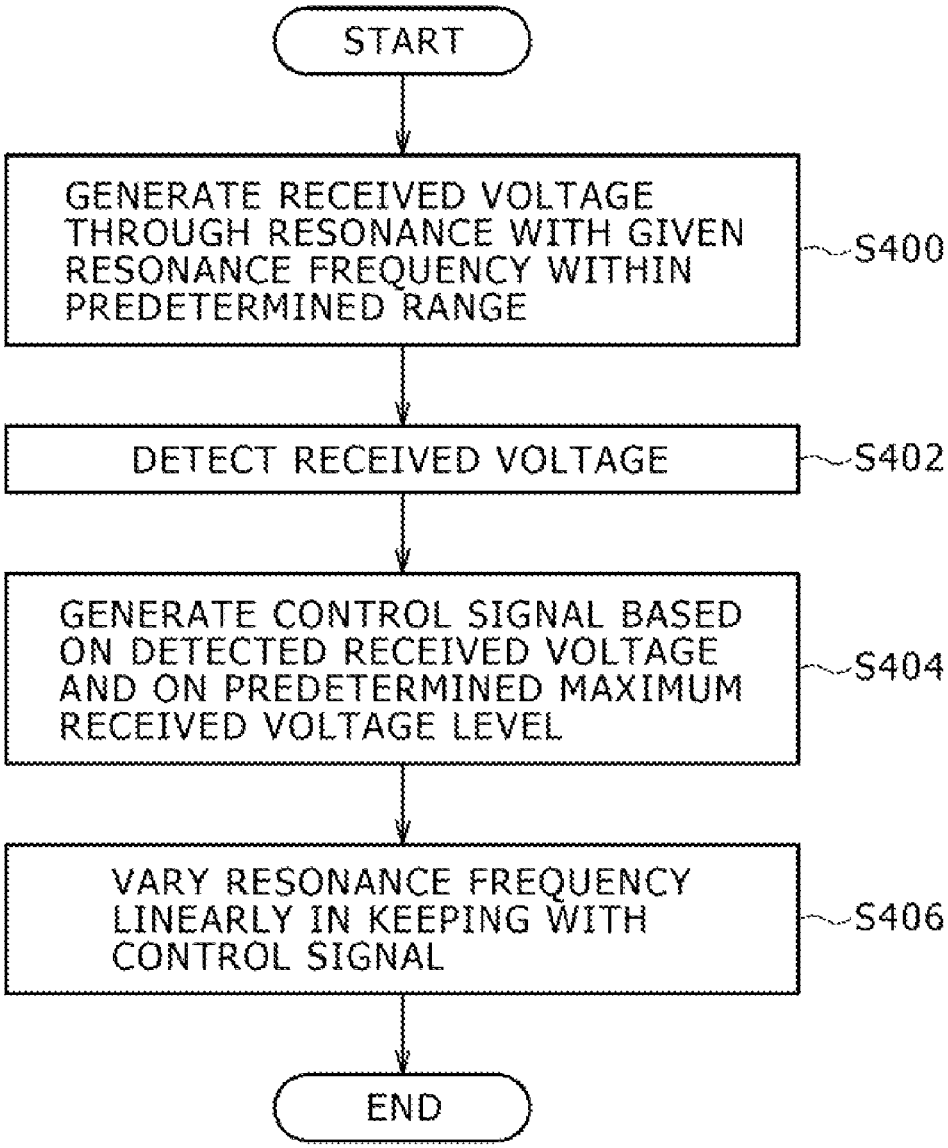
FIG. 9 is a flowchart of steps constituting a received voltage controlling method for use with the information processing terminal of the first, the second, and the third embodiments.

Described below in reference to FIG. 9 is the preferred received voltage controlling method for use with the information processing terminal of the first, the second, and the third embodiments of the present invention discussed above.

FIG. 9 is a flowchart of steps constituting the received voltage controlling method for use with the information processing terminal of the first, the second, and the third embodiments.

On receiving magnetic field energy from the reader/writer in step S400, the information processing terminal generates a received voltage through resonance with a given resonance frequency within a predetermined range.

In step S402, the information processing terminal detects the received voltage generated in step S400.

In step S404, the information processing terminal generates a control signal based on the received voltage detected in step S402 and on a predetermined maximum received voltage value. The maximum received voltage may be determined beforehand in keeping with the dynamic range of the information processing terminal. Alternatively, the maximum received voltage may be determined on the basis of a minimum received voltage necessary for the information processing terminal to process data transmitted from the reader/writer.

In step S406, the information processing terminal varies the resonance frequency linearly in accordance with the control signal generated in step S404. The resonance frequency may be varied through changes either in capacitance or in inductance based on the control signal.

As described, the information processing terminal of the first, the second and the third embodiments of the present invention has its received voltage suitably controlled according to the inventive received voltage controlling method. The method of which the flow is shown in FIG. 9 is not a one-shot operation; it is a process that continues as long as the information processing terminal is tapping magnetic field energy from the reader/writer, i.e., while the information processing terminal is in communication with the reader/writer.

With the inventive received voltage controlling method in use, the information processing terminal of the first, the second, and the third embodiments can thus operate stably regardless of the received voltage being high or low.

It is to be understood, that while the present-invention has been described in conjunction with specific embodiments with reference to the accompanying drawings, it is evident that many alternatives, modifications and variations will become apparent to those skilled in the art in light of the foregoing description. Accordingly, it is intended that the present invention embrace all such alternatives, modifications and variations as fall within the spirit and scope of the appended claims.

For example, the information processing terminal 350 of the third embodiment was shown to vary the resonance frequency by retaining a fixed capacitance and changing inductance in the resonance circuit section 252 based on the control signal. Alternatively, the information processing terminal may vary the resonance frequency by retaining a fixed inductance and changing capacitance in the resonance circuit section 252 in keeping with the control signal. This is a modification of the present invention that differs from the first through the third embodiments discussed above. Still, that modification can vary the resonance frequency linearly in accordance with the control signal and thus provides substantially the same effects as any of the first, the second and the third embodiments of the present invention.

Furthermore, the information processing terminal of the first through the third embodiments of the present invention described above was shown to vary either capacitance or inductance in the resonance circuit section 252 on the basis of the control signal. Alternatively, both capacitance and inductance may be varied in the resonance circuit section 252 in accordance with the control signal. This is another modification of the present invention that differs from the first, the second, and the third embodiments discussed above. Still, that modification can also vary the resonance frequency linearly according to the control signal and thus provides substantially the same effects as any of the first, the second and the third embodiments of the present invention.

Thus the scope of the present invention should be determined by the appended claims and their legal equivalents, rather than by the examples given.

While preferred embodiments of the present invention have been described using specific terms, such description is for illustrative purposes only, and it is to be understood that changes and variations may be made without departing from the spirit or scope of the following claims.

What is claimed is:

1. An information processing terminal comprising:

a resonance circuit unit set at a resonance frequency and configured to receive data and power from a reader/writer in noncontact fashion, wherein the resonance frequency varies linearly in accordance with a control signal;

a maximum received voltage setting unit configured to output a reference voltage for defining a maximum received voltage to be output by the resonance circuit unit;

a control signal generation unit configured to generate the control signal in accordance with the received voltage and the reference voltage; and a transmit-receive processing section configured to operate on the received voltage to process the data;

wherein the received voltage is not in excess of a predetermined level.

2. The information processing terminal according to claim 1, wherein the resonance circuit unit comprises a resonance circuit including:

a fixed inductance unit configured to function as an antenna having a predetermined inductance; and a variable capacitance unit configured to vary a capacitance thereof in accordance with the control-signal.

3. The information processing terminal according to claim 1, wherein the resonance circuit unit comprises a resonance circuit including:

a variable inductance unit configured to vary an inductance thereof in accordance with the control signal; and a fixed capacitance unit configured to have a fixed capacitance.

4. The information processing terminal according to claim 1, wherein the information processing terminal is configured to be an integrated circuit card.

5. The information processing terminal according to claim 1, wherein the information processing terminal is configured to be a portable communication apparatus.

6. A received voltage controlling method comprising the steps of:

receiving data and power in noncontact fashion from a reader/writer so as to generate a received voltage at a given resonance frequency within a predetermined range;

detecting the received voltage;

generating a control signal based on the detected received voltage and on an outputted reference voltage defining a maximum received voltage level; and varying the resonance frequency linearly according to the control signal.

7. The method of claim 6, further comprising the step of:

varying a capacitance in accordance with the control signal.

8. The method of claim 6, further comprising:

varying an inductance in accordance with the control signal.

* * * * *